US007997689B2

(12) United States Patent
Peng et al.

(10) Patent No.: US 7,997,689 B2
(45) Date of Patent: Aug. 16, 2011

(54) DROPLET EJECTION DEVICE FOR A HIGHLY VISCOUS LIQUID

(75) Inventors: Yu Yin Peng, Hsin Chu Hsien (TW); Chin Pin Chien, Hsin Chu Hsien (TW); Tien Ho Gau, Hsin Chu Hsien (TW)

(73) Assignee: Industrial Technology Research Institute, Hsin Chu Hsien (TW)

( * ) Notice: Subject to any disclaimer, the term of this patent is extended or adjusted under 35 U.S.C. 154(b) by 856 days.

(21) Appl. No.: 11/964,442

(22) Filed: Dec. 26, 2007

(65) Prior Publication Data

US 2009/0115825 A1 May 7, 2009

(30) Foreign Application Priority Data

Nov. 1, 2007 (TW) ..... 96141148 A

(51) Int. Cl.
*B41J 2/05* (2006.01)

(52) U.S. Cl. ..... 347/65

(58) Field of Classification Search ..... 347/20, 347/21, 25, 56, 65, 66
See application file for complete search history.

(56) References Cited

U.S. PATENT DOCUMENTS 4,378,564 A 3/1983 Cross et al.
4,380,018 A * 4/1983 Andoh et al. ..... 347/68
4,613,875 A * 9/1986 Le et al. ..... 347/21
4,849,909 A 7/1989 Yamada et al.
4,970,535 A * 11/1990 Oswald et al. ..... 347/25
6,383,561 B1 * 5/2002 Moffat et al. ..... 427/180

FOREIGN PATENT DOCUMENTS

| | | |
|---|---|---|
| JP | 2-265670 A | 10/1990 |
| JP | 2006-96042 A | 4/2006 |
| JP | 2006-96042 A | 10/2007 |
| TW | I314478 | 6/2006 |
| TW | 200709944 | 3/2007 |
| TW | I288663 | 10/2007 |

* cited by examiner

*Primary Examiner* — Anh T. N. Vo

(74) *Attorney, Agent, or Firm* — Venable LLP; Jeffri A. Kaminski; Todd R. Farnsworth

(57) ABSTRACT

A droplet ejection device for a highly viscous liquid includes a micro flow channel filled with a highly viscous liquid and having an inlet and an outlet channel; at least a branch channel communicated with the outlet channel; a highly-viscous-liquid supply device connected to the inlet so as to supply the highly viscous liquid to the micro flow channel; a gas supply device connected to the branch channel so as to supply a gas to the outlet channel by way of the branch channel; and at least a control valve mounted between the branch channel and the gas supply device so as to control an intermittent supply of the gas from the branch channel to the outlet channel to interrupt the highly-viscous-liquid flow in the outlet channel and to prompt the highly viscous fluid to form a droplet to be ejected out of the micro flow channel.

22 Claims, 8 Drawing Sheets

DROPLET EJECTION DEVICE FOR A HIGHLY VISCOUS LIQUID

BACKGROUND OF THE INVENTION

1. Field of the Invention

The present invention provides a droplet ejection device for a highly viscous liquid, particularly an ejection device capable of intermittent discharge of highly viscous liquid droplets.

2. Description of the Related Art

Digital ejection technology usually atomizes liquid for ejection purposes. However, the application of this technology is constrained by the viscosity requirement as low as a few tens cP. Digital ejection technology was first applied to packing machines in the early years, serving to further identify the features and conditions of the product by ejecting droplets to the target subject to form appropriate images and characters. Such packing machines are available through Japanese companies such as Marsh (U.S. Pat. No. 4,378,564) and Hitachi (U.S. Pat. No. 4,849,909). However, as mentioned earlier, digital ejection technology works only with liquid whose viscosity is no more than a few tens cP, and whose droplet diameter is approximately 0.5 μm; equivalent to several tens pL in volume. On the other hand, paste-like highly viscous liquid with more than thousands or even tens of thousands cP in viscosity is commonly applied to ejection devices in glue spreaders, sprayers, or food machines, etc. Given its extremely high viscosity, such kind of liquid can only be ejected in large quantities by the machinery equipment or applied to the surface of the target subject in large areas, unable to be atomized for digital ejection. While highly viscous liquid, such as adhesives or tin paste, can be melted out by heating to reduce its viscosity to meet the requirement of digital ejection, it is also certain that, by doing so, the physical and chemical properties of the fluid will be changed, too.

FIG. 10 illustrates both the ejecting amount and the viscosity of an ejected droplet, wherein the X-axis represents ejecting amount, or unit volume of every intermittent ejection, while the Y-axis represents liquid viscosity. By referring to the figure, the performance and the limitations of current liquid ejection devices can be easily understood. Take an ink jet printer, for instance. The viscosity of ink jet ranges from 1 cP to 10 cP, whereas the ejecting amount of the intermittently jetted ink reaches from 1 pL to 100 pL. Thanks to its low viscosity, the ink jet can be atomized to the advantage of image configuration. On the other hand, for liquid with higher viscosity, such as spray adhesives whose viscosity amounts to approximately 10,000 cP, the ejecting amount of every intermittent ejection can be more than 10,000 pL. Accordingly, every single ejection of the spray adhesives should be considered a continuous stream unable to be atomized.

In view of the advancement of micro-electro-mechanical technologies in recent years, new technologies that are able to directly issue paste-like liquid and to precisely control the size of the liquid droplet at the same time will play a significant role in promoting direct ejection for microcircuit printing technology. Therefore, it is desirable to develop a droplet ejection device for a highly viscous liquid to control the size of the droplet while ejecting highly viscous liquid.

SUMMARY OF THE INVENTION

The present invention aims to provide a droplet ejection device for a highly viscous liquid capable of controlling the size of the droplet while ejecting highly viscous liquid.

Such a droplet ejection device for a highly viscous liquid comprises: a micro flow channel filled with a highly viscous liquid and having an inlet and an outlet channel; at least a branch channel communicated with the outlet channel; a highly-viscous-liquid supply device connected to the inlet so as to supply the highly viscous liquid to the micro flow channel; a gas supply device connected to the branch channel so as to supply a gas to the outlet channel by way of the branch channel; and at least a control valve mounted between the branch channel and the gas supply device so as to control an intermittent supply of the gas from the branch channel to the outlet channel, in an attempt to interrupt the highly-viscous-liquid flow in the outlet channel and to prompt the highly viscous liquid to form droplet ejection out of the micro flow channel.

Preferably, the branch channel is connected to the outlet channel with a slanted angle.

Preferably, the droplet ejection device for a highly viscous liquid further comprises a main flow chamber disposed between the inlet and the outlet channel.

Preferably, a heater is further disposed between the main flow chamber and the outlet channel.

In addition, the present invention also provides a droplet ejection module for a highly viscous liquid comprising: a substrate having a plurality of droplet ejection units for a highly viscous liquid, wherein each of the droplet ejection units for a highly viscous liquid has a micro flow channel and at least a branch channel, with the micro flow channel having an inlet and an outlet channel; a base providing a plurality of first openings and a plurality of second openings corresponding respectively to every individual inlet and every individual branch channel on the substrate, wherein the plurality of first openings are communicated with a first fluid transmission line disposed inside the base and the plurality of second openings are communicated with a second fluid transmission line disposed inside the base; and a cover plate enabling the substrate to be secured between the base and the cover plate.

Preferably, the first fluid transmission line is connected to a highly-viscous-liquid supply device.

Preferably, the second fluid transmission line is connected to a gas supply device.

Preferably, the droplet ejection module for a highly viscous liquid further comprises a control valve mounted between the second fluid transmission line and the gas supply device so as to intermittently control the moving direction of the gas in the branch channel.

Preferably, the gas is air.

Preferably, the internal diameter of the outlet channel is smaller than that of the inlet.

Preferably, the branch channel is connected to the outlet channel with a slanted angle.

Preferably, the pressure of the gas supply device is larger than that of the highly-viscous-liquid supply device.

Accordingly, the present invention is able to control the size of the droplet while ejecting highly viscous liquid. Moreover, as shown in FIG. 10, the present invention has succeeded in atomizing the ejected highly viscous liquid in favor of digital ejection, further paving the way for the application of the invention in direct ejection for microcircuit printing technology.

DETAILED DESCRIPTION OF THE PREFERRED EMBODIMENTS

Figure 1:
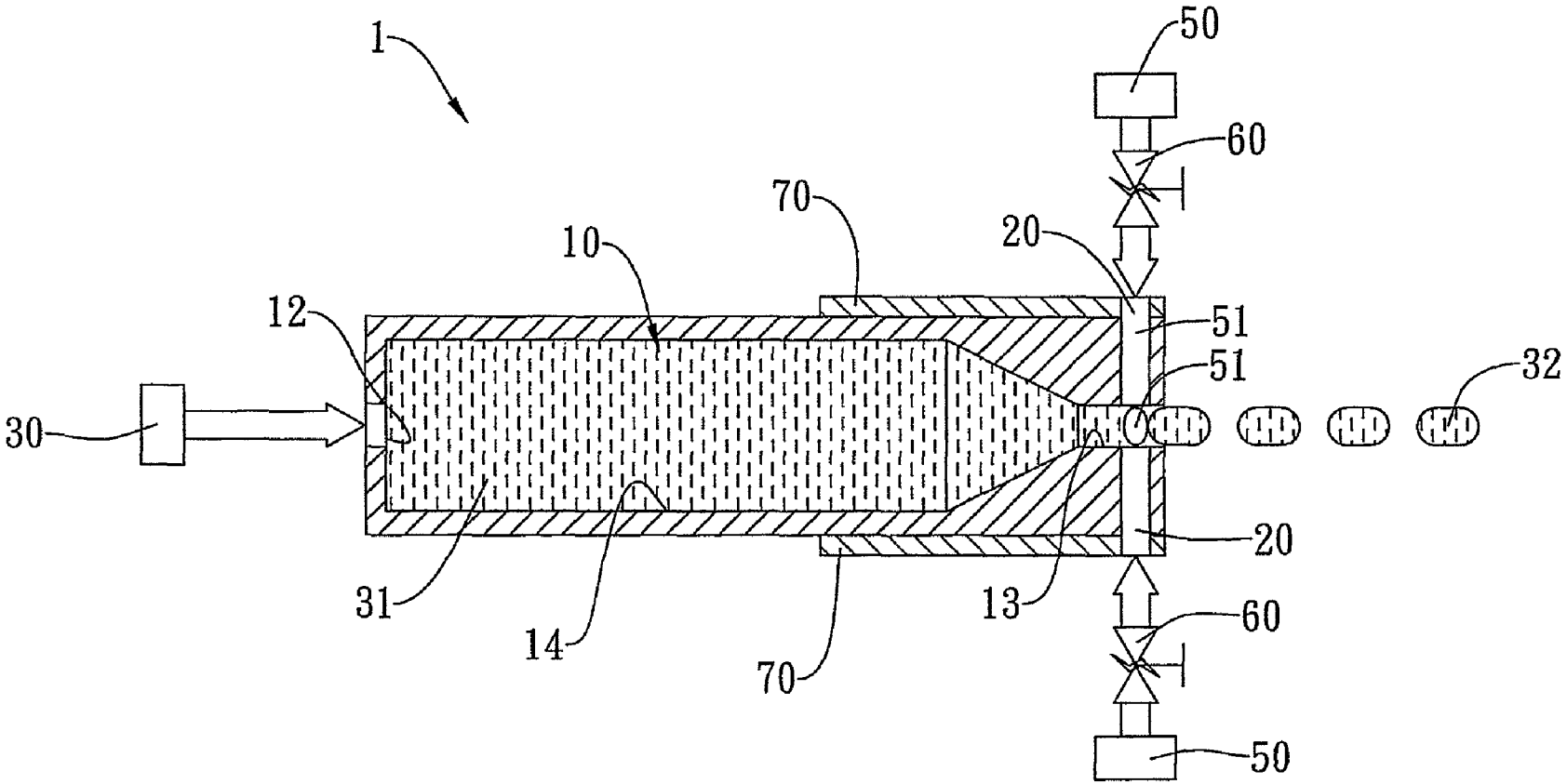
FIG. 1 shows a schematic view of a droplet ejection device for a highly viscous liquid according to the present invention.

FIG. 1 shows a schematic view of a droplet ejection device for a highly viscous liquid according to the present invention. The droplet ejection device for a highly viscous liquid 1 according to the present invention comprises a micro flow channel 10, at least a branch channel 20, a highly-viscous-liquid supply device 30, a gas supply device, and at least a control valve 60. The micro flow channel 10 is secured to a substrate and filled with a to-be-ejected highly viscous liquid 31. The micro flow channel 10 also has an inlet 12 and an outlet channel 13 disposed at either end, with the internal diameter of the outlet channel 13 smaller than that of the inlet 12. A main flow chamber 14 is disposed between the outlet channel 13 and the inlet 12 for containing a highly viscous liquid 31. In this embodiment, there are two branch channels 20 connected respectively to either side of the outlet channel 13, as shown in FIG. 1. The highly-viscous-liquid supply device 30 is connected to the inlet 12 of the micro flow channel 10 for supplying the highly viscous liquid 31 to the micro flow channel 10. In addition to supplying the highly viscous liquid 31 to the micro flow channel 10, the highly-viscous-liquid supply device 30 also controls the amount of the highly viscous liquid 31 supplied and the pressure to supply the highly viscous liquid 31. The end of the branch channel 20 opposite to where the micro flow channel 10 meets the outlet channel 13 is connected to a gas supply device 50 for supplying a gas 51, which is air, to the outlet channel 13 by way of the branch channel 20. A control valve 60 is mounted between the branch channel 20 and the gas supply device 50 for controlling an intermittent supply of the gas 51 from the branch channel 20 to the outlet channel 13 and for regulating both the amount of the air 51 supplied and the pressure to supply the gas 51, so that, when the highly viscous liquid 31 flows towards the outlet channel 13 for ejection, the air 51 will interrupt the highly-viscous-liquid flow and prompt the highly viscous liquid 31 to form intermittently ejected droplets 32. Besides, the present invention also comprises a heater 70 for heating up the highly viscous liquid in the micro flow channel whenever it cools down, so as to expedite the activation of the present invention.

Figure 2:
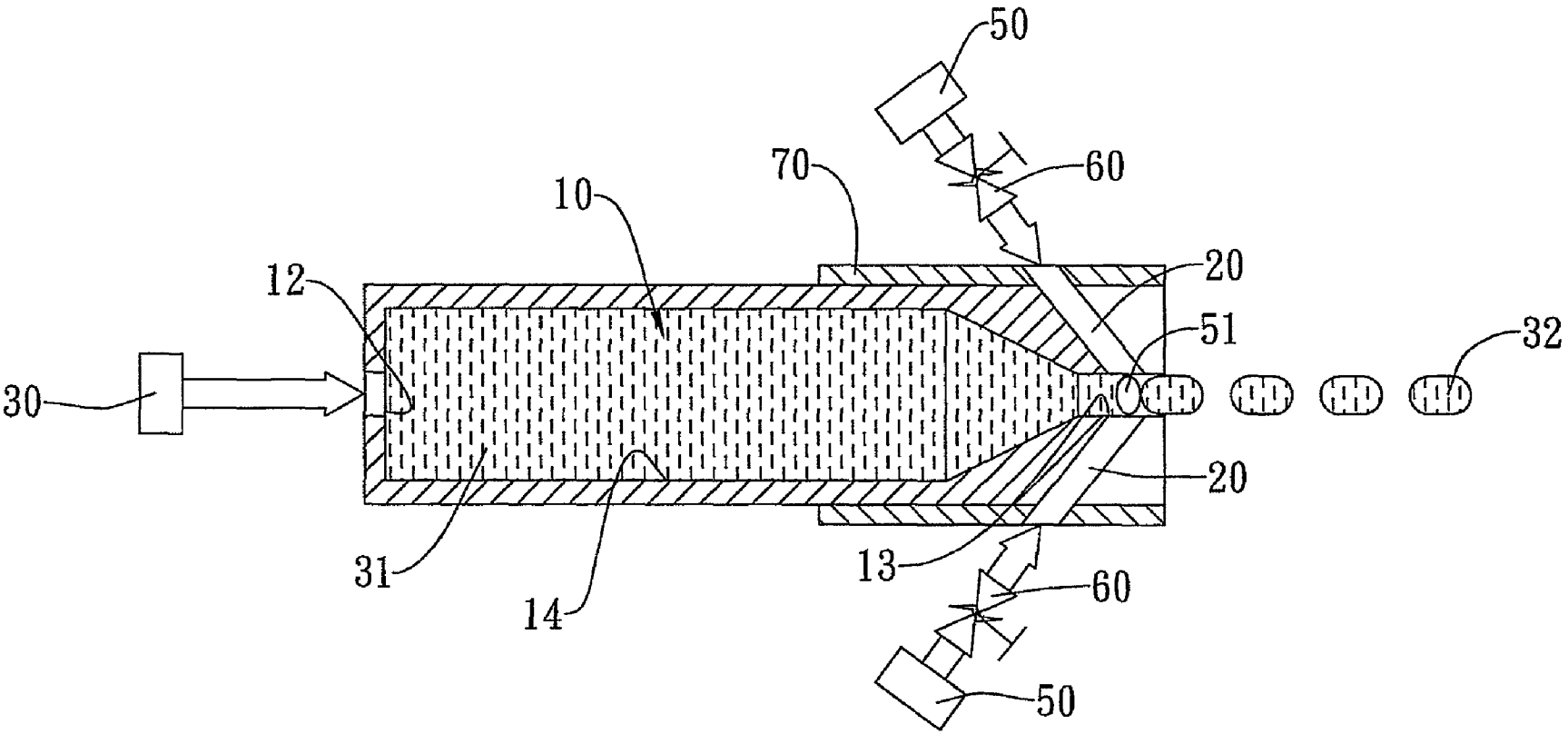
FIG. 2 shows a schematic view of another embodiment of the droplet ejection device for a highly viscous liquid according to the present invention.

FIG. 2 shows a schematic view of another embodiment of the droplet ejection device for a highly viscous liquid according to the present invention. Basically, this embodiment resembles the preceding one as illustrated in FIG. 1, so most of its features will not be repeated here. This embodiment differs in the fact that the branch channel 20 is connected to either side of the outlet channel 13 with a slanted angle. Besides, the number of the branch channels 20 connected to the outlet channel 13 can be decided at one's discretion. For example, there can be one branch channel 20 connected to the outlet channel 13. There can also be two branch channels 20, or more, connected respectively to either side of the outlet channel 13 to regulate the ejection interval. Preferably, the pressure provided by the gas supply device 50 to supply the gas 51 to the branch channel 20 is larger than that provided by the highly-viscous-liquid supply device 30 to supply the highly viscous liquid 31 to the micro flow channel 10.

Figure 3A:
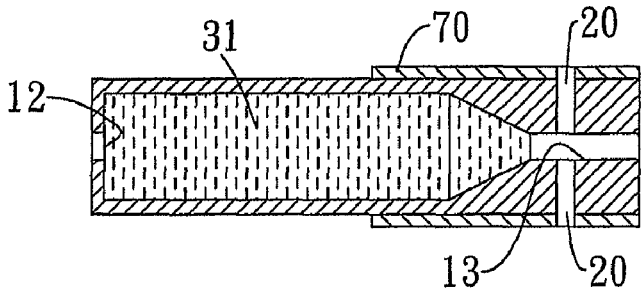
FIGS. 3A to 3F show schematic views of the operation of the droplet ejection device for a highly viscous liquid according to the present invention.
Figure 3B:
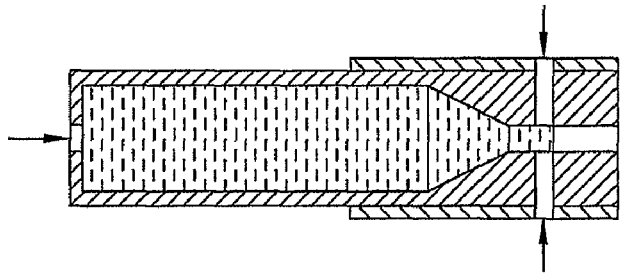
Figure 3C:
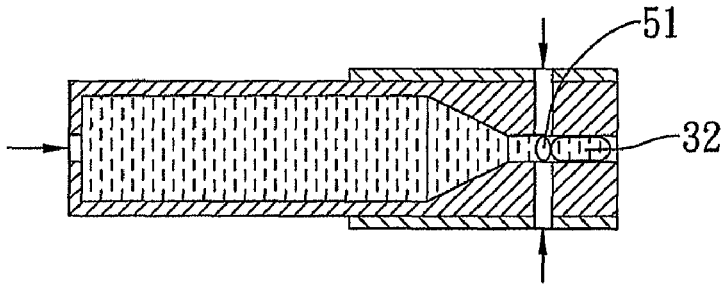
Figure 3D:
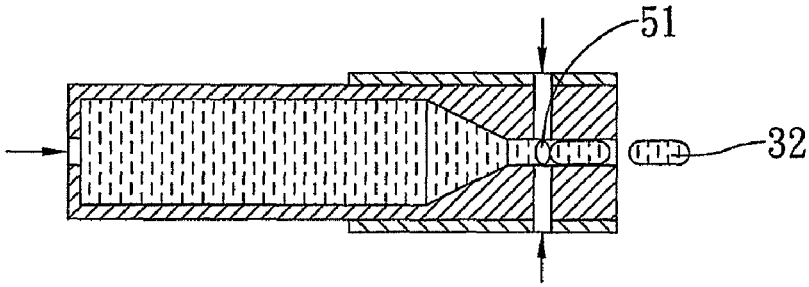
Figure 3E:
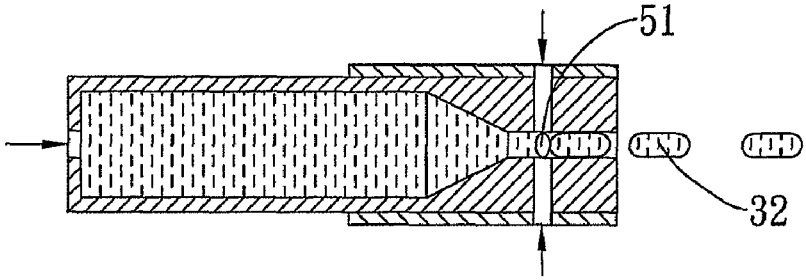
Figure 3F:
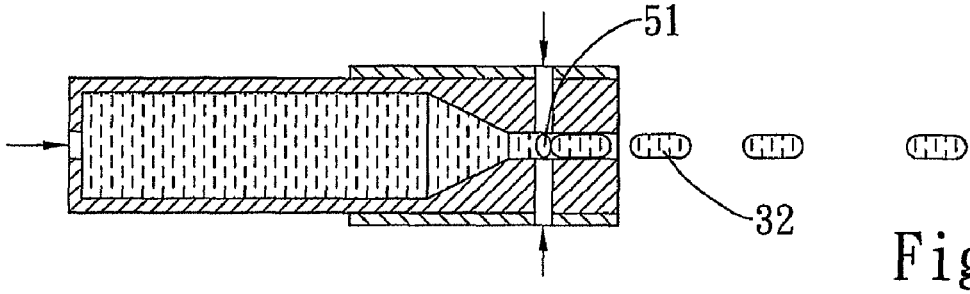

FIGS. 3A to 3F show schematic views of the operation of the droplet ejection device for a highly viscous liquid according to the present invention. By injecting gas 51, such as air, and by controlling parameters such as the pressure to supply the air and the amount of the air provided, the present invention regulates the size of the ejected droplet as well as the overall ejecting amount of the highly viscous liquid 31, so as to accomplish the ejection of the highly-viscous-liquid droplets 21. As FIGS. 3A and 3B show, the highly-viscous-liquid supply device 30 supplies the highly viscous liquid 31, ensuring that the highly viscous liquid 31 moves smoothly in the micro flow channel 10. When the pressure provided by the highly-viscous-liquid supply device 30 builds up, the highly viscous liquid 31 will be forced out via the outlet channel 13 of the micro flow channel. Furthermore, when air is injected by the branch channel 20, the highly-viscous-liquid flow in the micro flow channel 10 will be interrupted, resulting in an intermittent supply of the highly-viscous-liquid droplet 32, as shown in FIG. 3C. Therefore, by controlling parameters such as the pressure provided by the highly-viscous-liquid supply device 30, the input pressure of the gas supply device 50, the input amount of the gas 51, and the diameter and length of the outlet channel 13 and the branch channel 20, etc., the present invention regulates both the size of the ejected droplet and the overall ejecting amount of the highly viscous liquid 31, accomplishing the ejection of the highly-viscous-liquid droplet 32, as FIGS. 3D to 3F show. The present invention is applicable to liquid whose viscosity is thousands or even tens of thousands cP. The volume of the ejected droplet measures approximately 10-50 pL.

Figure 5:
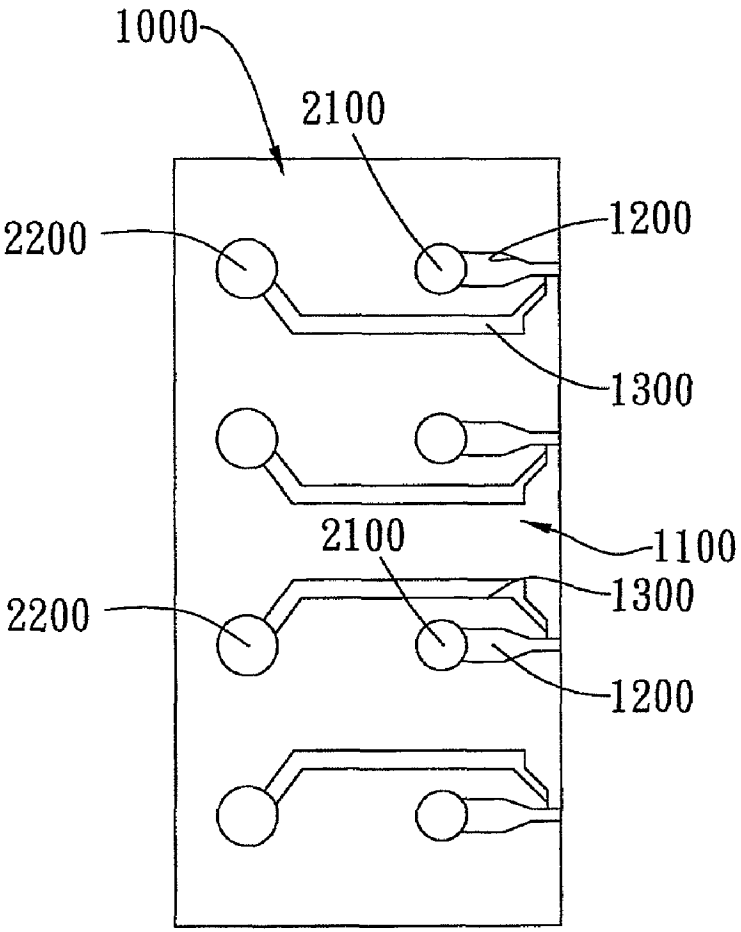
FIG. 5 shows a schematic view of the second embodiment of the droplet ejection module for a highly viscous liquid according to the present invention.
Figure 4:
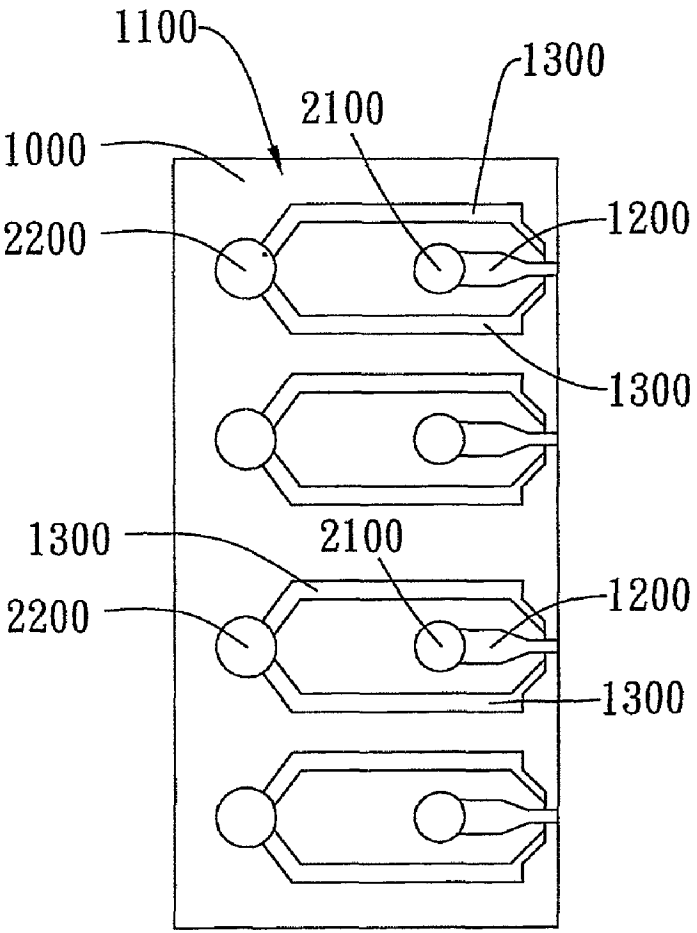
FIG. 4 shows a schematic view of the first embodiment of a droplet ejection module for a highly viscous liquid according to the present invention.

FIG. 4 and FIG. 5, respectively, show the schematic view of the first and the second embodiment of a droplet ejection module for a highly viscous liquid according to the present invention. Through the modular design or for the purpose of mass production, the present invention places a plurality of droplet ejection units 1100 for a highly viscous liquid on a substrate 1000. The micro flow channel 1200 is taken as a nozzle, so as to enable diverse ejection performances by controlling, in order, the ejection condition of the highly viscous liquid in every single micro flow channel 1200 when under digital ejection control. As FIG. 4 shows, the first embodiment of the droplet ejection module for a highly viscous liquid according to the present invention exemplifies a two-sided arrangement of the branch channel 1300. As FIG. 5 shows, the second embodiment of the droplet ejection module for a highly viscous liquid according to the present invention illustrates an one-sided arrangement of the branch channel 1300.

Figure 6:
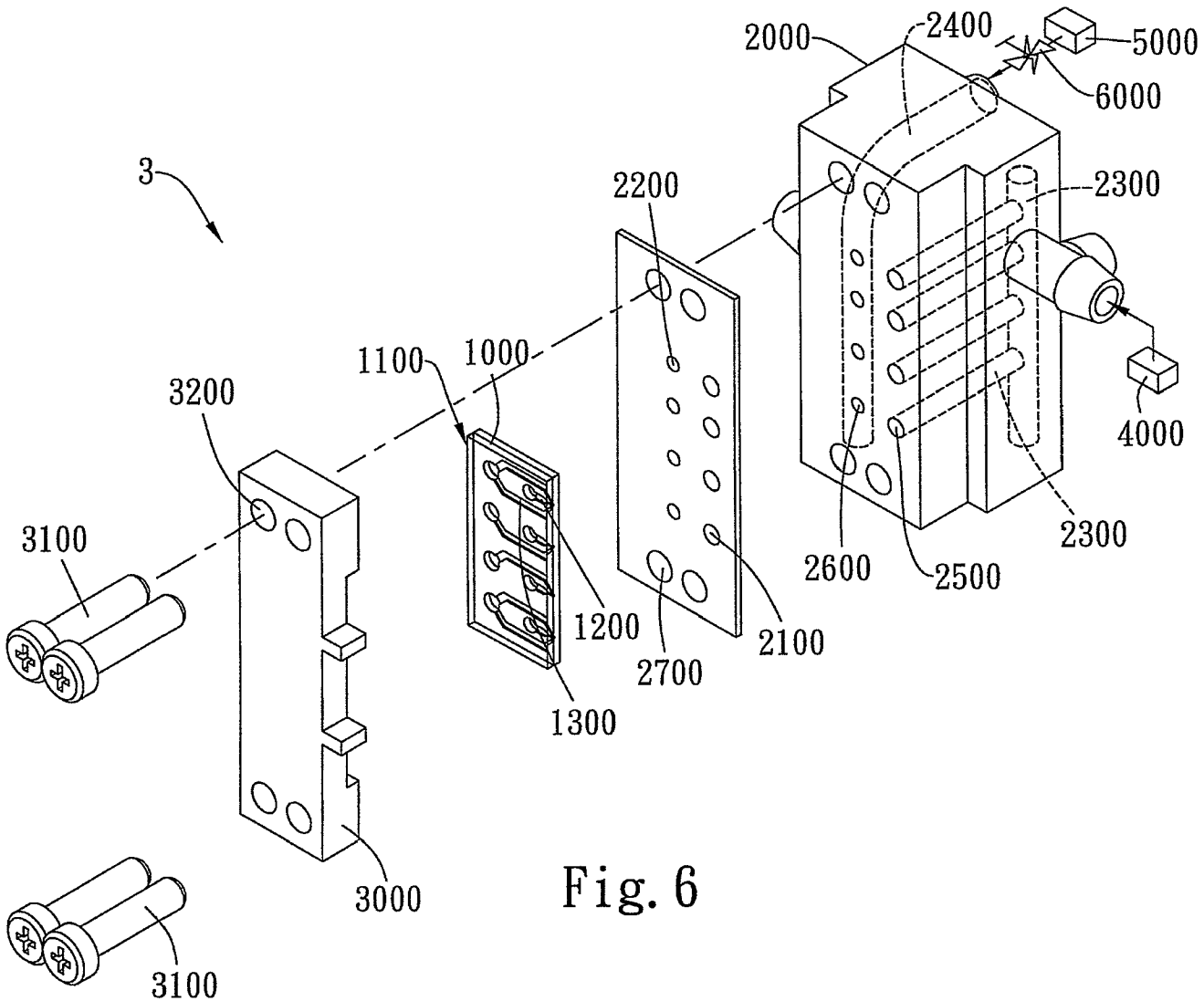
FIG. 6 shows an exploded view of the droplet ejection module for a highly viscous liquid according to the present invention.

FIG. 6 shows an exploded view of the droplet ejection module for a highly viscous liquid according to the present invention. The droplet ejection module for a highly viscous liquid comprises a substrate 1000, a base 2000, and a cover plate 3000. The substrate 1000 can be made of various materials, such as diced wafers, and contains a plurality of droplet ejection units for a highly viscous liquid 1100, whose number is subject to demand and the size of the substrate 1000. There are four droplet ejection units for a highly viscous liquid 1100 in the present embodiment, including at least two different types of units. Every individual droplet ejection unit for a highly viscous liquid comprises a micro flow channel 1200 and at least a branch channel 1300. One type of the droplet ejection unit for a highly viscous liquid 1100 contains two branch channels 1300 while the other type contains one branch channel 1300. The micro flow channel 1200 comprises an inlet 1400 and an outlet channel 1500. Every single inlet 1400 is connected to a corresponding first opening 2100 for receiving a highly viscous liquid 4100, whereas every single branch channel 1300 is connected to a corresponding second opening 2200 for receiving gas 5100. The base 2000 is provided with a plurality of third openings 2500 corresponding respectively to every individual inlet 1400 on the substrate and a plurality of fourth openings 2600 corresponding respectively to every individual branch channel 1300. The plurality of third openings 2500 are in communication with a first fluid transmission line 2300 disposed inside the base 2000 and the plurality of fourth openings 2600 are in communication with at least a second fluid transmission line 2400 disposed inside the base 2000. As a result, the highly viscous liquid 4100 and the air 5100 can enter the micro flow channel 1200 and the branch channel 1300, respectively, by way of the corresponding first fluid transmission line 2300 and the corresponding second fluid transmission line 2400. The cover plate 3000 enables the substrate 1000 to be fastened between the base 2000 and the cover plate 3000 by means of bolts 3100. In addition, the first fluid transmission line 2300 is connected to a highly-viscous-liquid supply device 4000 and the second fluid transmission line 2400 is connected to a gas supply device 5000. The present embodiment further comprises a control valve 6000 mounted between the second fluid transmission line 2400 and the gas supply, device 5000, so as to intermittently control the moving direction of the gas 5100 in the branch channel 1300.

Figure 7:
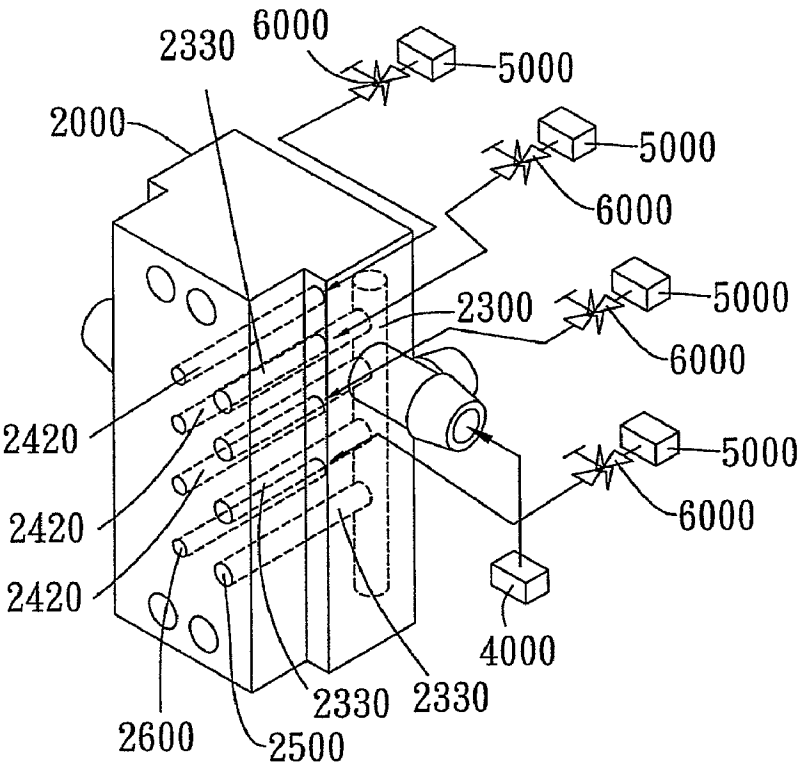
FIG. 7 shows a schematic view of the first embodiment of the fluid transmission line in the droplet ejection module for a highly viscous liquid according to the present invention.

FIG. 7 shows a schematic view of the first embodiment of the fluid transmission line in the droplet ejection module for a highly viscous liquid according to the present invention. This embodiment comprises a first fluid transmission line 2300 communicated with a plurality of third openings 2500 disposed between the first fluid transmission line 2300 and the first openings 2100, allowing the highly viscous liquid 4100 to enter the micro flow channels 1200 by way of the first fluid transmission line 2300. More specifically, in this embodiment, the highly-viscous-liquid supply device 4000 provides the highly viscous liquid 4100 to the first fluid transmission line 2300 before the highly viscous liquid 4100 enters individual branch fluid transmission lines 2310 and exits the third openings 2500. This embodiment also comprises a plurality of second fluid transmission lines 2420 communicated respectively with a plurality of fourth openings 2600 disposed between the second fluid transmission lines 2420 and the second openings 2200, allowing the air 5100 to enter individual branch channels 1300 by way of respective second fluid transmission lines 2420. In this embodiment, the plurality of second fluid transmission lines 2420 are separately positioned and respectively provided with gas 5100 by individual gas supply devices 5000. Moreover, a control valve 6000 is mounted between every second fluid transmission line 2420 and its corresponding gas supply device 5000 for controlling the supply of gas 5100 to the second fluid transmission line 2400, so as to intermittently control the moving direction of the gas 5100 in the branch channel 1300.

Figure 8:
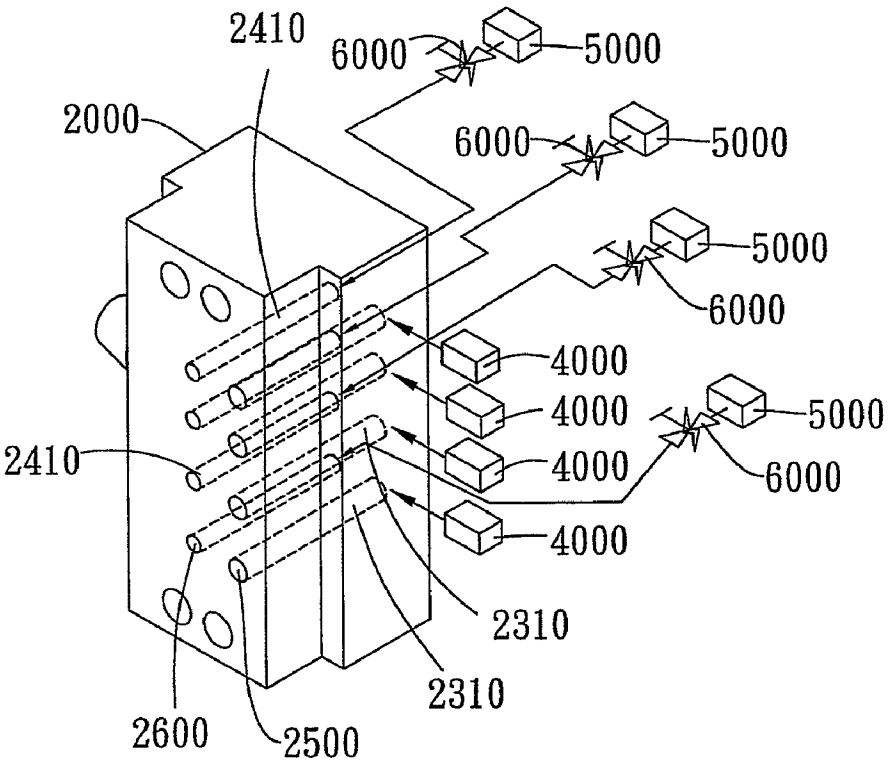
FIG. 8 shows a schematic view of the second embodiment of the fluid transmission line in the droplet ejection module for a highly viscous liquid according to the present invention.

FIG. 8 shows a schematic view of the second embodiment of the fluid transmission line in the droplet ejection module for a highly viscous liquid according to the present invention. This embodiment comprises a plurality of first fluid transmission lines 2310 communicated respectively with a plurality of third openings 2500 disposed between the first fluid transmission lines 2310 and the first openings 2100, allowing a plurality of highly-viscous-liquid supply devices 4000 to provide the highly viscous liquid 4100 to the plurality of first fluid transmission lines 2310, respectively, before the highly viscous liquid 4100 enters individual micro flow channels 1200. This embodiment also comprises a plurality of second fluid transmission lines 2410 communicated respectively with a plurality of fourth openings 2600 disposed between the second fluid transmission lines 2410 and the second openings 2200, allowing a plurality of gas supply devices 5000 to provide the air 5100 to the plurality of second fluid transmission lines 2410, respectively, before the air 5100 enters individual branch channels 1300. In this embodiment, the first fluid transmission lines 2310 are separately positioned and respectively provided with the highly viscous liquid 4100 by individual highly-viscous-liquid supply devices 4000. Similarly, the second fluid transmission lines 2410 are separately positioned and respectively provided with gas 5100 by individual gas supply devices 5000 Moreover, a control valve 6000 is mounted between every second fluid transmission line 2410 and its corresponding gas supply device 5000 for controlling the supply of gas 5100 to the second fluid transmission line 2410, so as to intermittently control the moving direction of the gas 5100 in the branch channel 1300.

The difference between this embodiment and the preceding one is that, in this embodiment, each individual first fluid transmission line 2310 has a corresponding highly-viscous-liquid supply device 4000, and each second fluid transmission line 2410 has a corresponding gas supply device 5000, too; whereas, in the prior embodiment, there is only one first fluid transmission line 2300 corresponding to one single highly-viscous-liquid supply device 4000, as opposed to the second fluid transmission lines 2420 each having a corresponding gas supply device 5000 of its own.

Figure 9:
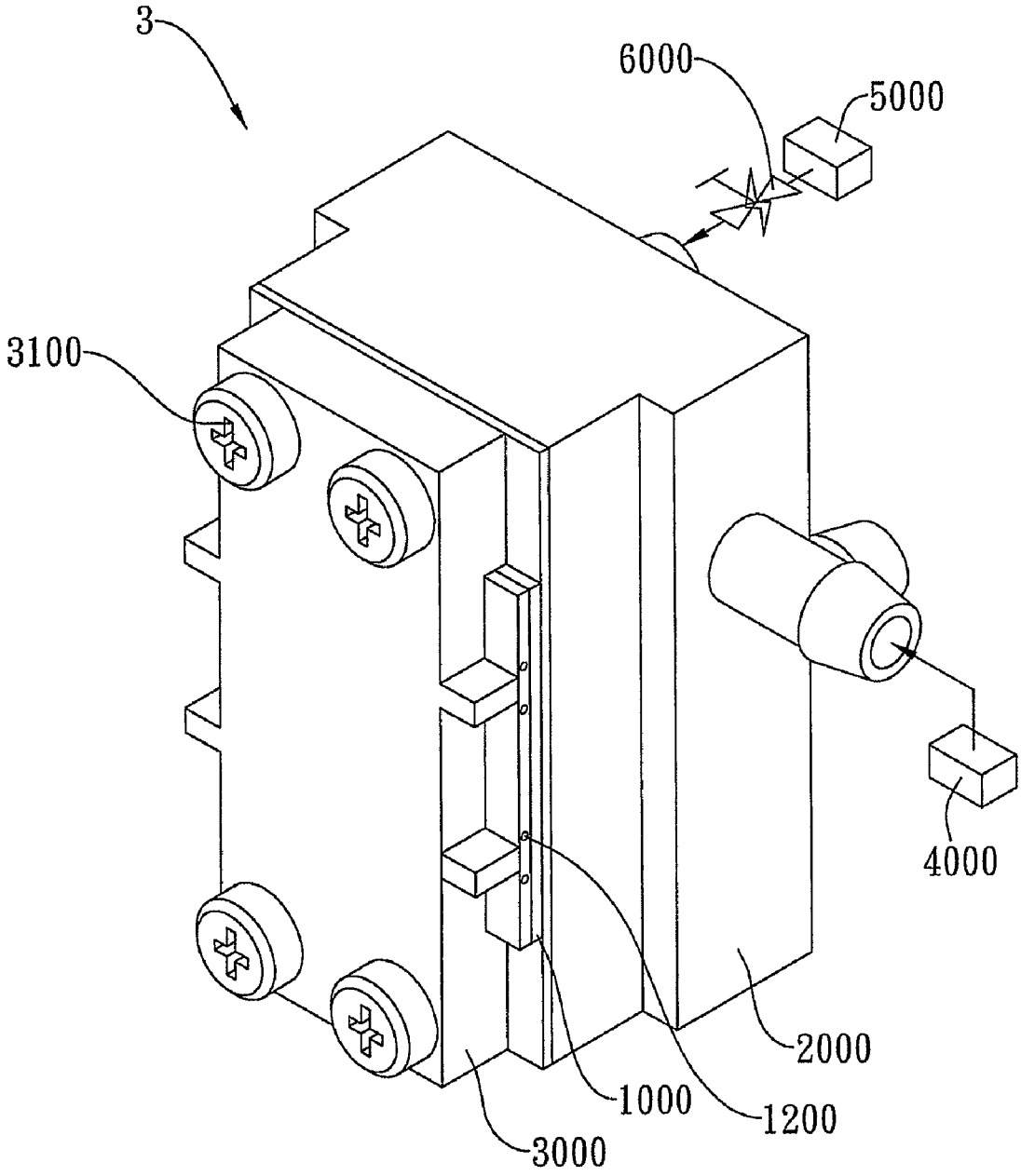
FIG. 9 shows a three dimensional view of the assembled droplet ejection module for a highly viscous liquid according to the present invention.
Figure 10:
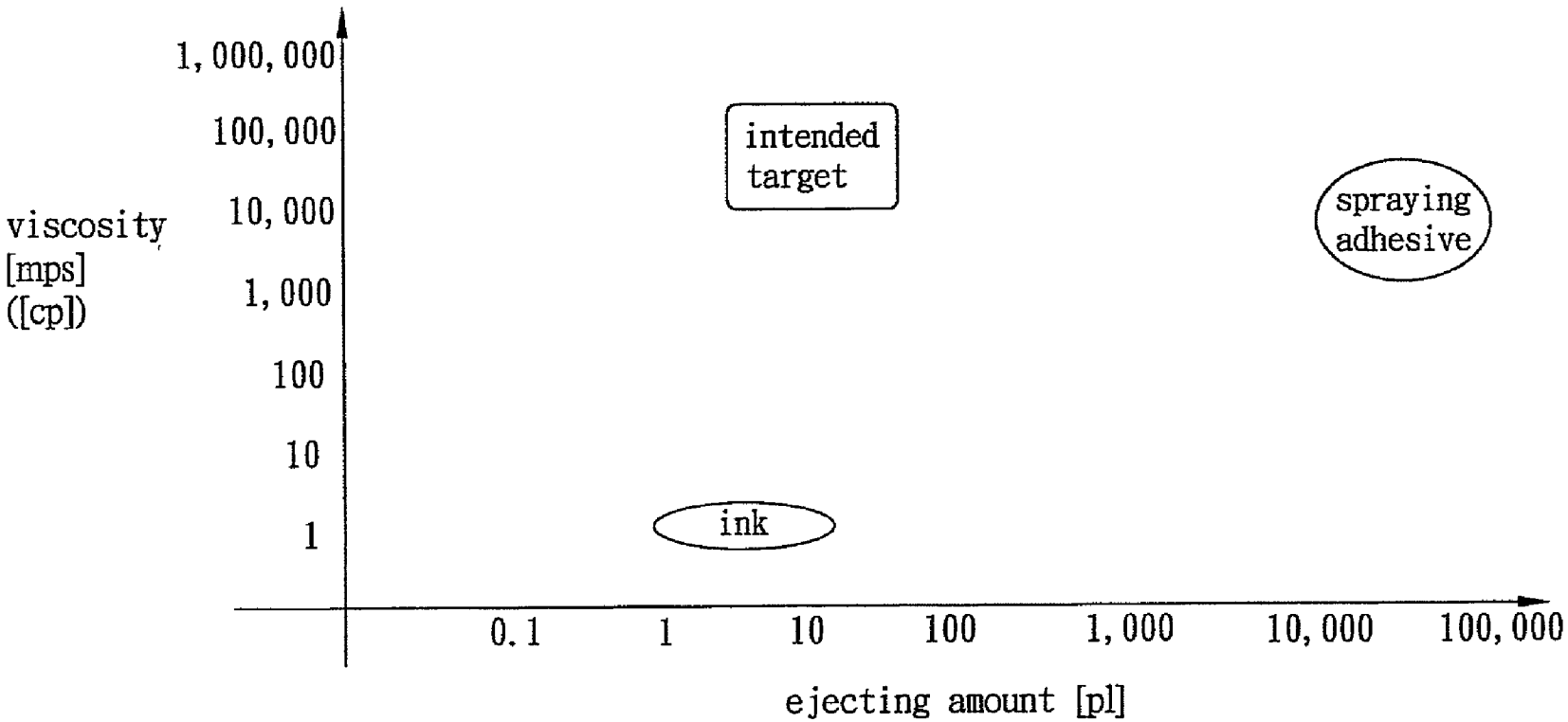
FIG. 10 illustrates the ejecting amount and the viscosity of regular droplets.

FIG. 9 shows a three dimensional view of the assembled droplet ejection module for a highly viscous liquid according to the present invention. Once assembled, the droplet ejection module for a highly viscous liquid 3 can be placed inside a micro mechanical equipment or device to atomize the intermittently ejected highly viscous liquid in favor of digital ejection, further paving the way for the application of the invention in direct ejection for microcircuit printing technology.

The preferred embodiments of the present invention have been disclosed in the examples. However, the examples should not be construed as a limitation on the actual applicable scope of the invention, and as such, all modifications and alterations without departing from the spirits of the invention and appended claims, including the other embodiments, shall remain within the protected scope and claims of the invention.

What is claimed is:

1. A droplet ejection device for a highly viscous liquid, comprising:

a micro flow channel filled with a highly viscous liquid and having an inlet and an outlet channel;

at least a branch channel communicated with the outlet channel;

a highly-viscous-liquid supply device connected to the inlet so as to supply the highly viscous liquid to the micro flow channel;

a gas supply device connected to the branch channel so as to supply a gas to the outlet channel by way of the branch channel; and at least a control valve mounted between the branch channel and the gas supply device so as to control an intermittent supply of the gas from the branch channel to the outlet channel to prompt the highly viscous liquid to form droplet ejection out of the micro flow channel.

2. The droplet ejection device for a highly viscous liquid as claimed in claim 1, wherein the internal diameter of the outlet channel is smaller than that of the inlet.

3. The droplet ejection device for a highly viscous liquid as claimed in claim 1, wherein the gas is air.

4. The droplet ejection device for a highly viscous liquid as claimed in claim 1, wherein the branch channel is connected to the outlet channel with a slanted angle.

5. The droplet ejection device for a highly viscous liquid as claimed in claim 1, wherein the pressure of the gas supply device is larger than that of the highly-viscous-liquid supply device.

6. The droplet ejection device for a highly viscous liquid as claimed in claim 1, further comprising a main flow chamber disposed between the inlet and the outlet channel.

7. The droplet ejection device for a highly viscous liquid as claimed in claim 6, further comprising a heater disposed between the main flow chamber and the outlet channel.

8. A droplet ejection module for a highly viscous liquid, comprising:

a substrate having a plurality of droplet ejection units for a highly viscous liquid, wherein each of the droplet ejection units for a highly viscous liquid has a micro flow channel and at least a branch channel, with the micro flow channel having an inlet and an outlet channel;

a base providing a plurality of third openings and a plurality of fourth openings corresponding respectively to every individual inlet and every individual branch channel on the substrate, wherein the plurality of third openings are communicated with at least a first fluid transmission line disposed inside the base and the plurality of fourth openings are communicated with at least a second fluid transmission line disposed inside the base; and a cover plate enabling the substrate to be secured between the base and the cover plate.

9. The droplet ejection module for a highly viscous liquid as claimed in claim 8, wherein the first fluid transmission line is connected to a highly-viscous-liquid supply device.

10. The droplet ejection module for a highly viscous liquid as claimed in claim 9, wherein a plurality of first fluid transmission lines are communicated respectively with the plurality of third openings disposed between the first fluid transmission lines and the first openings, allowing a plurality of highly-viscous-liquid supply devices to provide the highly viscous liquid to individual first fluid transmission lines, respectively, before the highly viscous liquid enters individual micro flow channels.

11. The droplet ejection module for a highly viscous liquid as claimed in claim 10, wherein the first fluid transmission lines are separately positioned and respectively provided with the highly viscous liquid by individual highly-viscous-liquid supply devices.

12. The droplet ejection module for a highly viscous liquid as claimed in claim 11, wherein the highly-viscous-liquid supply device provides the highly viscous liquid to the first fluid transmission line before the highly viscous liquid enters individual branch fluid transmission lines and exits the third openings.

13. The droplet ejection module for a highly viscous liquid as claimed in claim 9, further comprising a first fluid transmission line communicated with a plurality of third openings disposed between the first fluid transmission line and the first openings, allowing the highly viscous liquid to enter the micro flow channels by way of the first fluid transmission line.

14. The droplet ejection module for a highly viscous liquid as claimed in claim 8, wherein the second fluid transmission line is connected to a gas supply device.

15. The droplet ejection module for a highly viscous liquid as claimed in claim 14, wherein a plurality of second fluid transmission lines are communicated respectively with the plurality of fourth openings disposed between the second fluid transmission lines and the second openings, allowing the gas supply device to provide the air to the plurality of second fluid transmission lines before the air enters individual branch channels.

16. The droplet ejection module for a highly viscous liquid as claimed in claim 15, wherein the second fluid transmission lines are separately positioned and respectively provided with air by individual gas supply devices.

17. The droplet ejection module for a highly viscous liquid as claimed in claim 16, wherein a control valve is mounted between every second fluid transmission line and its corresponding gas supply device for controlling the supply of gas to the second fluid transmission line.

18. The droplet ejection module for a highly viscous liquid as claimed in claim 8, wherein the gas is air.

19. The droplet ejection module for a highly viscous liquid as claimed in claim 8, wherein the internal diameter of the outlet channel is smaller than that of the inlet.

20. The droplet ejection module for a highly viscous liquid as claimed in claim 8, wherein the branch channel is connected to the outlet channel with a slanted angle.

21. The droplet ejection module for a highly viscous liquid as claimed in claim 8, wherein the pressure of the gas supply device is larger than that of the highly-viscous-liquid supply device.

22. The droplet ejection module for a highly viscous liquid as claimed in claim 8, wherein every single inlet is connected to a corresponding first opening for receiving the highly viscous liquid, and every single branch channel is connected to a corresponding second opening for receiving the air.

* * * * *